US010794391B2

(12) United States Patent
Adachi et al.

(10) Patent No.: US 10,794,391 B2
(45) Date of Patent: Oct. 6, 2020

(54) CENTRIFUGAL IMPELLER, ELECTRIC BLOWER, ELECTRIC VACUUM CLEANER, AND HAND DRYER

(71) Applicants: Mitsubishi Electric Corporation, Tokyo (JP); Mitsubishi Electric Home Appliance Co., Ltd., Fukaya-shi, Saitama (JP)

(72) Inventors: Naho Adachi, Tokyo (JP); Takashi Ikeda, Tokyo (JP); Mamoru Hayatsu, Fukaya (JP); Mitsumasa Hamazaki, Fukaya (JP); Masaya Teramoto, Fukaya (JP)

(73) Assignees: Mitsubishi Electric Corporation, Tokyo (JP); Mitsubishi Electric Home Appliance Co., Ltd., Fukaya-shi, Saitama (JP)

( * ) Notice: Subject to any disclaimer, the term of this patent is extended or adjusted under 35 U.S.C. 154(b) by 0 days.

(21) Appl. No.: 16/336,184

(22) PCT Filed: Oct. 28, 2016

(86) PCT No.: PCT/JP2016/082126
§ 371 (c)(1),
(2) Date: Mar. 25, 2019

(87) PCT Pub. No.: WO2018/078811
PCT Pub. Date: May 3, 2018

(65) Prior Publication Data
US 2019/0242397 A1 Aug. 8, 2019

(51) Int. Cl.
*F04D 29/30* (2006.01)
*F04D 29/28* (2006.01)

(52) U.S. Cl.
CPC ..... *F04D 29/30* (2013.01); *F04D 29/281* (2013.01); *F05D 2240/301* (2013.01);
(Continued)

(58) Field of Classification Search
CPC ..... A47L 9/22; A47L 5/28; A47L 5/24; A47L 9/00; A47L 7/04; F04D 29/30;
(Continued)

(56) References Cited

U.S. PATENT DOCUMENTS 4,520,541 A * 6/1985 Miki ..... B23P 15/006 29/889.23
5,002,461 A * 3/1991 Young ..... F04D 29/284 416/183
(Continued)

FOREIGN PATENT DOCUMENTS

CN 1984592 A 6/2007
CN 103270310 A 8/2013
(Continued)

OTHER PUBLICATIONS

International Search Report of the International Searching Authority dated Jan. 24, 2017 for the corresponding International application No. PCT/JP2016/082126 (and English translation).
(Continued)

*Primary Examiner* — Robert J Scruggs
(74) *Attorney, Agent, or Firm* — Posz Law Group, PLC

(57) ABSTRACT

A centrifugal impeller high in efficiency and suction power, an electric blower having the centrifugal impeller, and an electrical apparatus provided with the electric blower are obtained. The centrifugal impeller includes a hub and a plurality of rotor blades. The plurality of rotor blades are coupled to a surface portion of the hub. At least one of the plurality of rotor blades includes an end portion, a first surface, and a second surface. The end portion includes a planar portion and a curved portion. The planar portion is continuous to the second surface and has a flat surface. The curved portion connects the planar portion and the first surface to each other and has a curved surface.

18 Claims, 7 Drawing Sheets

(52) U.S. Cl.
CPC .. *F05D 2240/303* (2013.01); *F05D 2240/304* (2013.01); *F05D 2240/307* (2013.01)

(58) Field of Classification Search
CPC ..... F04D 29/281; F05D 2240/301; F05D 2240/303; F05D 2240/304; F05D 2240/307
See application file for complete search history.

(56) References Cited

U.S. PATENT DOCUMENTS

| | | | | |
|---|---|---|---|---|
| 2004/0005220 | A1* | 1/2004 | Kawamoto | F04D 29/284 416/223 R |
| 2007/0144034 | A1 | 6/2007 | Kameishi | |
| 2012/0121432 | A1 | 5/2012 | Wakai et al. | |
| 2013/0266450 | A1* | 10/2013 | Tomita | F04D 29/284 416/223 R |
| 2014/0056734 | A1* | 2/2014 | Yamauchi | F04D 29/22 417/321 |
| 2016/0061214 | A1* | 3/2016 | Hayamitsu | F04D 25/08 416/223 B |

FOREIGN PATENT DOCUMENTS

| | | | |
|---|---|---|---|
| JP | S63-060097 | U | 4/1988 |
| JP | 2004-044473 | A | 2/2004 |
| JP | 2007-192034 | A | 8/2007 |
| JP | 2010-166998 | A | 8/2010 |
| JP | 2011-027089 | A | 2/2011 |
| JP | 2014-057759 | A | 4/2014 |
| JP | 2016-017461 | A | 2/2016 |

OTHER PUBLICATIONS

Office Action dated Mar. 1, 2018 issued in corresponding TW patent application No. 106111344 (and English translation).
Office Action dated Mar. 3, 2020 issued in corresponding JP patent application No. 2018-547041 (and English translation).

* cited by examiner

CENTRIFUGAL IMPELLER, ELECTRIC BLOWER, ELECTRIC VACUUM CLEANER, AND HAND DRYER

CROSS REFERENCE TO RELATED APPLICATION

This application is a U.S. national stage application of PCT/JP2016/082126 filed on Oct. 28, 2016, the contents of which are incorporated herein by reference.

TECHNICAL FIELD

This invention relates to a centrifugal impeller, an electric blower, an electric vacuum cleaner, and a hand dryer.

BACKGROUND ART

An electric blower used for an electrical apparatus such as an electric vacuum cleaner or a hand dryer has conventionally been known. A centrifugal impeller represents one example of a member forming the electric blower. For example, Japanese Patent Laying-Open No. 2011-27089 (which is called PTL 1 below) discloses lessening collision loss at a front edge and achieving higher efficiency by forming a front edge of a rotor blade of a centrifugal impeller as a curved surface and gradually decreasing a curvature of the curved surface from an inner circumferential side toward an outer circumference.

CITATION LIST

Patent Literature

PTL 1: Japanese Patent Laying-Open No. 2011-27089

SUMMARY OF INVENTION

Technical Problem

Reduction in size and weight of an electrical apparatus such as an electric vacuum cleaner has increasingly been demanded in recent years, and reduction in size and weight of individual components employed in the electrical apparatus has been required. Therefore, decrease in diameter of a centrifugal impeller employed in an electric blower representing one example of the components has also been demanded. In a centrifugal impeller small in diameter, a shape of a front edge of a rotor blade highly affects efficiency. For example, when a front edge of a rotor blade is formed only by a curved surface, a flow of air at the front edge of the rotor blade is separated at the curved surface and consequently loss increases. Consequently, efficiency of the electric blower has disadvantageously been lowered.

The present invention was made to solve the problem above, and an object thereof is to provide a centrifugal impeller which achieves less loss at a rotor blade and high efficiency and suction power even with a small diameter, an electric blower having the centrifugal impeller, and an electrical apparatus provided with the electric blower.

Solution to Problem

A centrifugal impeller according to the present disclosure is provided with a hub and a plurality of rotor blades. The hub has a circular outer geometry in a plan view. The hub includes a central portion and a surface portion. The central portion protrudes in a direction of an axis of rotation of the hub. The surface portion is inclined from the central portion toward an outer circumferential portion of the hub. The plurality of rotor blades are coupled to the surface portion of the hub. At least one of the plurality of rotor blades includes an end portion, a first surface, and a second surface. The end portion is located on a front side in a direction of rotation of the plurality of rotor blades. The first surface is continuous to the end portion and located on the front side in the direction of rotation. The second surface is continuous to the end portion and located on a side opposite to the first surface. The end portion includes a planar portion and a curved portion. The planar portion is continuous to the second surface and has a flat surface. The curved portion connects the planar portion and the first surface to each other and has a curved surface.

Advantageous Effects of Invention

According to the above, a flow of air into an end portion on a front side in a direction of rotation, that is, a front edge portion, of a rotor blade is rectified as air flows along a planar portion, and air flows toward the second surface which is a negative pressure surface without separating from a surface of the end portion. A flow of air is smoothly guided toward the first surface which is a pressure surface along a curved portion of the end portion. Therefore, separation of air at the front edge portion is suppressed, loss in the front edge portion is lessened, and an electric blower high in efficiency and suction power can be obtained.

DESCRIPTION OF EMBODIMENTS

Figure 1:
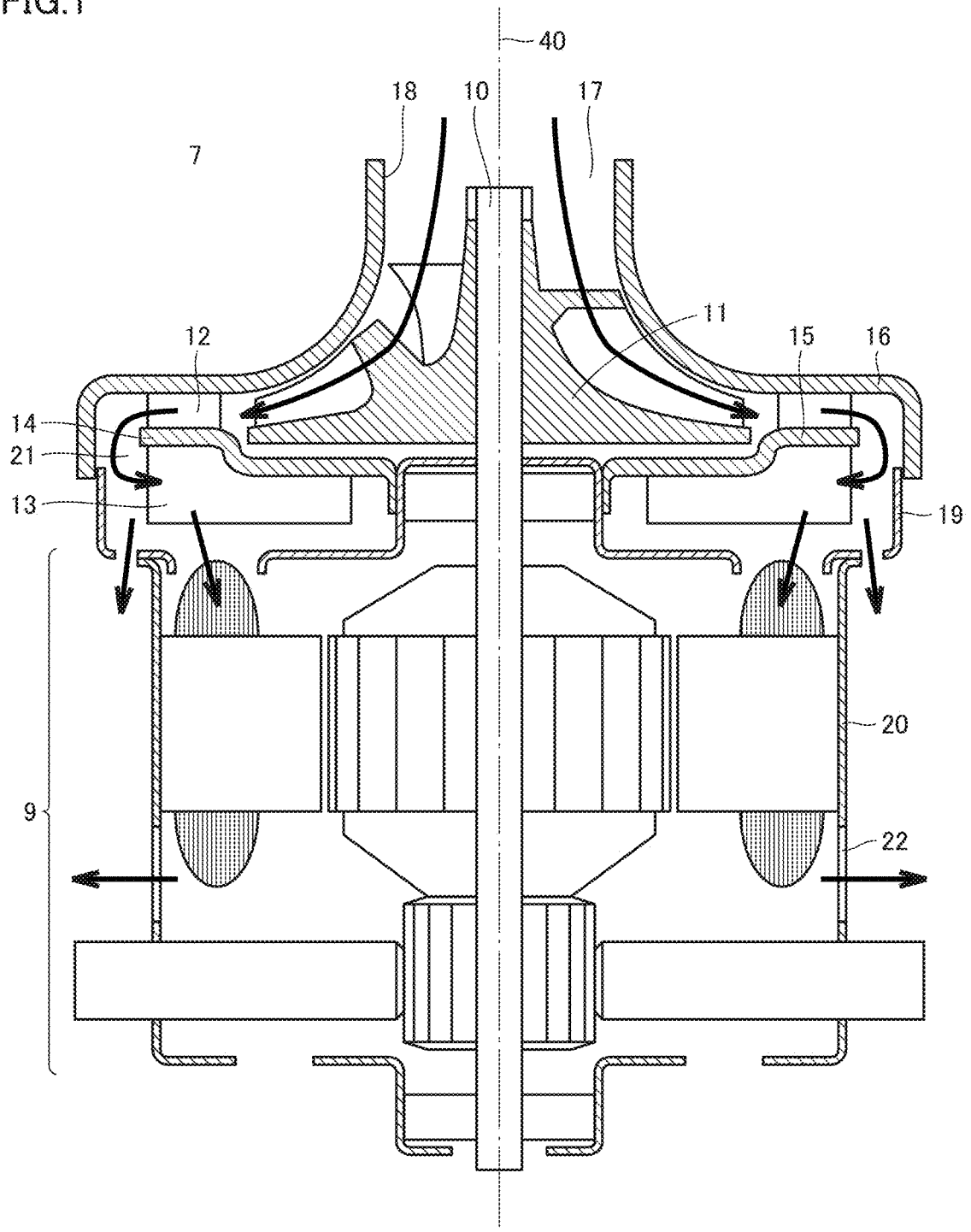
FIG. 1 is a vertical cross-sectional view of an electric blower in a first embodiment of the present invention.

An embodiment of the present invention will be described below with reference to the drawings. The same or corresponding elements in the drawings below have the same reference characters allotted and description thereof will not be repeated.

First Embodiment

<Configuration of Centrifugal Impeller and Electric Blower>

Figure 2:
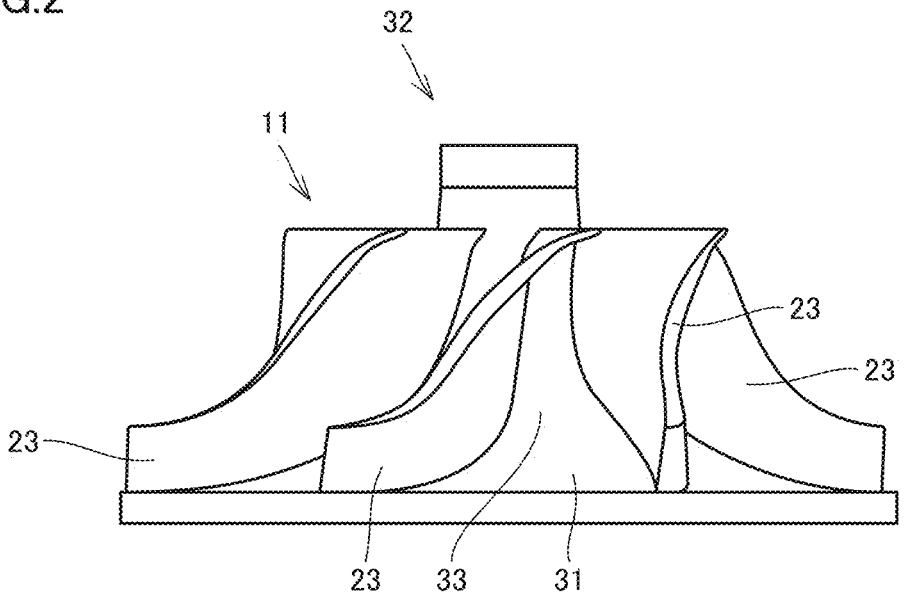
FIG. 2 is a front view of a centrifugal impeller in the first embodiment of the present invention.
Figure 3:
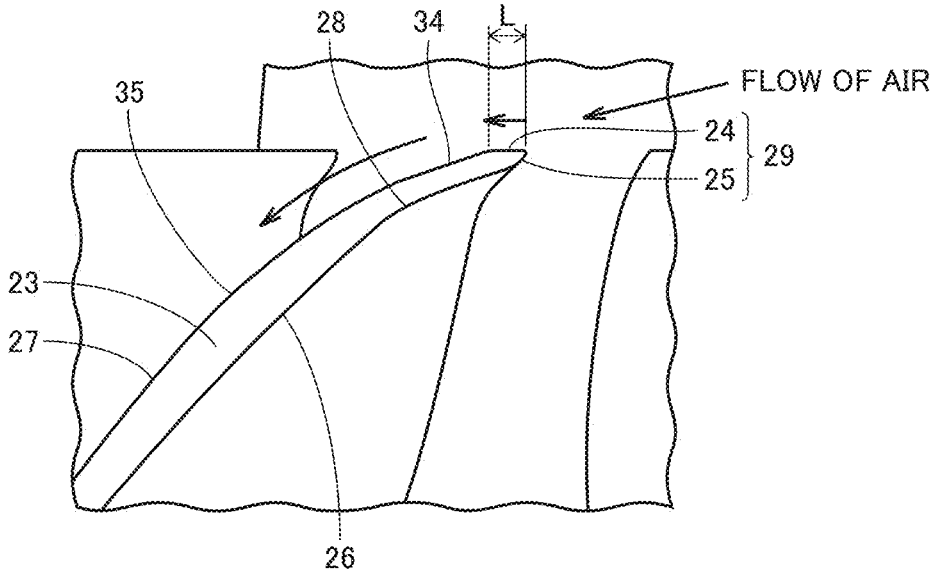
FIG. 3 is an enlarged view of a front surface on a front edge side of the centrifugal impeller in the first embodiment of the present invention.
Figure 4:
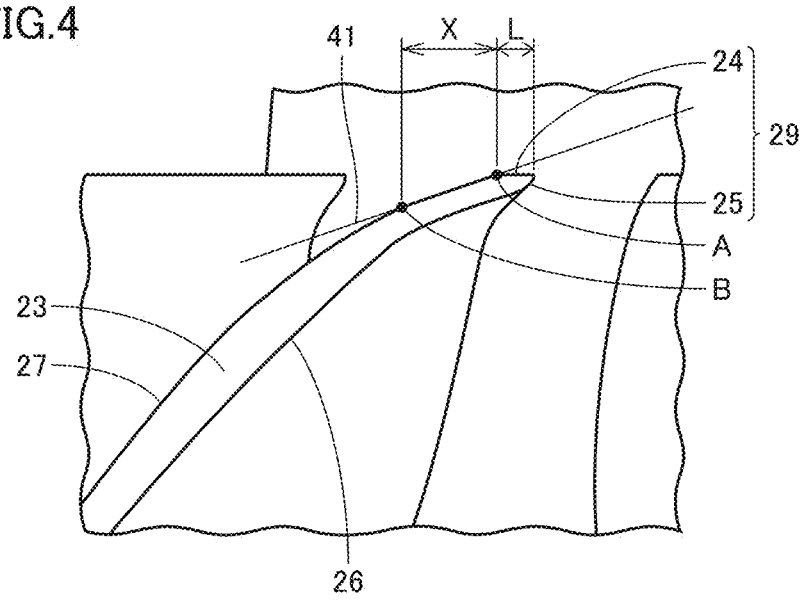
FIG. 4 is a schematic diagram for illustrating an angle of inclination on the front edge side of the centrifugal impeller in the first embodiment of the present invention.
Figure 5:
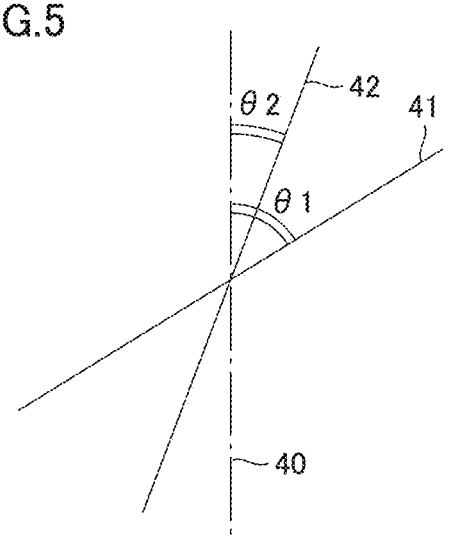
FIG. 5 is a schematic diagram for illustrating relation of angles of inclination between a radially inner circumferential side and a radially outer circumferential side of the front edge portion of a rotor blade of the centrifugal impeller in the first embodiment of the present invention.
Figure 6:
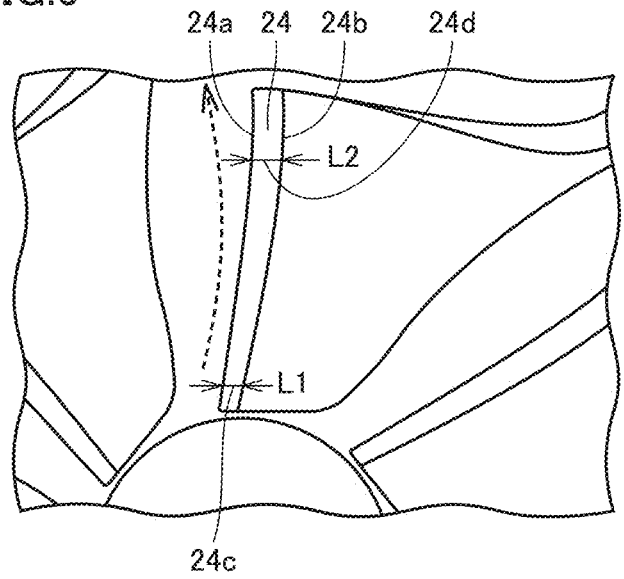
FIG. 6 is a partially enlarged view of an upper surface of the rotor blade of the centrifugal impeller in the first embodiment of the present invention.
Figure 7:
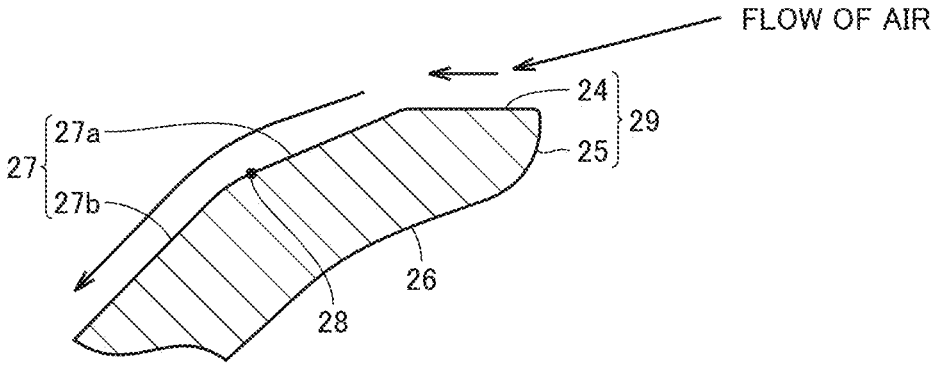
FIG. 7 is an enlarged view of a cross-section on the front edge side of the rotor blade of the centrifugal impeller in the first embodiment of the present invention.

FIG. 1 is a schematic cross-sectional view of an electric blower according to a first embodiment of the present invention. FIG. 2 is a front view of a centrifugal impeller of the electric blower shown in FIG. 1. FIG. 3 is an enlarged view of a front surface on a front edge side of the centrifugal impeller shown in FIG. 2. FIG. 4 is a schematic diagram for illustrating an angle of inclination on the front edge side of a rotor blade of the centrifugal impeller shown in FIG. 2. FIG. 5 is a schematic diagram for illustrating relation of angles of inclination between a radially inner circumferential side and a radially outer circumferential side of the rotor blade of the centrifugal impeller shown in FIG. 2. FIG. 6 is a partially enlarged view of an upper surface of the rotor blade of the centrifugal impeller shown in FIG. 2. FIG. 7 is an enlarged view of a cross-section on the front edge side of the centrifugal impeller shown in FIG. 2. A centrifugal impeller and an electric blower according to the first embodiment will be described with reference to FIGS. 1 to 7.

The electric blower shown in FIGS. 1 to 4 is an electric blower according to the present embodiment and employed in an electrical apparatus such as an electric vacuum cleaner or a hand dryer. An arrow in FIGS. 1 and 3 shows a flow of air.

As shown in FIGS. 1 to 4, the electric blower according to the embodiment of the present invention includes a centrifugal impeller 11 according to the first embodiment of the present invention, a motor portion 9, and a fan cover 16. Centrifugal impeller 11 includes a hub 31 and a plurality of rotor blades 23. Motor portion 9 rotates centrifugal impeller 11 by means of a shaft 10. Centrifugal impeller 11 is fixed to shaft 10. Hub 31 has a two-dimensional outer geometry in a circular shape. Hub 31 includes a central portion 32 protruding in a direction of extension of shaft 10 which is a direction of an axis of rotation of centrifugal impeller 11 and a surface portion 33 inclined from central portion 32 toward an outer circumferential portion. A plurality of rotor blades 23 are provided at a distance from one another in a circumferential direction of hub 31 and coupled to surface portion 33 of hub 31. From a different point of view, centrifugal impeller 11 includes substantially conical hub 31 and rotor blades 23. A plurality of rotor blades 23 are provided in the circumferential direction and coupled to hub 31.

An end portion 29 which is a front edge of rotor blade 23 is formed by a planar portion 24 and a curved portion 25. Curved portion 25 is coupled to a first surface 26 which is a pressure surface of rotor blade 23 on a side of the direction of rotation. Planar portion 24 is coupled to a second surface 27 which is a negative pressure surface located opposite to first surface 26 of rotor blade 23. From a different point of view, centrifugal impeller 11 includes hub 31 and a plurality of rotor blades 23. Hub 31 has a circular outer geometry in a plan view. Hub 31 includes central portion 32 and surface portion 33. Central portion 32 protrudes in a direction of the axis of rotation of hub 31. Surface portion 33 is a portion inclined from central portion 32 toward the outer circumferential portion of hub 31. The plurality of rotor blades 23 are coupled to surface portion 33 of hub 31. At least one of the plurality of rotor blades 23 includes end portion 29, first surface 26, and second surface 27. End portion 29 is located on a front side in the direction of rotation of the plurality of rotor blades 23. First surface 26 is continuous to end portion 29 and located on the front side in the direction of rotation. Second surface 27 is continuous to end portion 29 and located opposite to first surface 26. End portion 29 includes planar portion 24 and curved portion 25. Planar portion 24 is continuous to second surface 27 and has a flat surface. Curved portion 25 connects planar portion 24 and first surface 26 to each other and has a curved surface. Planar portion 24 is provided substantially horizontally in FIG. 1. Planar portion 24 is arranged to extend in a direction perpendicular to the direction of the axis of rotation.

A direction in which second surface 27 extends on a side of end portion 29 in an outermost circumferential portion of rotor blade 23 is defined as a direction shown with a line segment 41 in FIG. 4. Line segment 41 is defined as a line segment which connects a point A which is a point of boundary between planar portion 24 and second surface 27 to a point B distant by a prescribed distance from point A on a side opposite in the direction of rotation in a cross-section of rotor blade 23 along the direction of rotation. With a width of planar portion 24 being defined as a width L, a distance X between point A and point B in the direction perpendicular to the direction of the axis of rotation, that is, the horizontal direction in FIG. 4, can be defined, for example, as two times as large as distance L.

A direction in which second surface 27 extends on the side of end portion 29 on the inner circumferential side of rotor blade 23 is defined as a line segment 42 shown in FIG. 5. A method of determining line segment 42 is similar to the method of determining line segment 41. Line segment 42 is defined as a line segment which connects a point A' which is a point of boundary between planar portion 24 and second surface 27 to a point B' distant by a prescribed distance from point A' toward a side opposite in the direction of rotation on the inner circumferential side of rotor blade 23. A distance between point A' and point B' in the horizontal direction in FIG. 4 can be defined as twice as large as width L of planar portion 24 on the inner circumferential side of rotor blade 23. As shown in FIG. 5, in centrifugal impeller 11 according to the present embodiment, an angle θ1 formed between the direction of extension of second surface 27 on the outer circumferential side and axis of rotation 40 is greater than an angle θ2 formed between the direction of extension of the second surface on the inner circumferential side and axis of rotation 40. From a different point of view, an angle of inclination of second surface 27 of rotor blade 23 with respect to the axis of rotation is greater on the outer circumferential side than on the inner circumferential side. From a yet different point of view, the outer circumferential side of rotor blade 23 is more inclined than the inner circumferential side thereof with respect to axis of rotation 40.

Planar portion 24 has width L in the direction of rotation of centrifugal impeller 11, which is a distance between an edge portion 24*a* located on the front side in the direction of rotation and a boundary portion 24*b* between planar portion 24 and second surface 27. As shown in FIG. 6, in planar portion 24, a width L2 on the outer circumferential side is relatively greater than a width L1 on a side of hub 31. From a different point of view, planar portion 24 is formed to extend radially outward from axis of rotation 40 (see FIG. 1). Planar portion 24 includes a first position 24*c* and a second position 24*d* in FIG. 6. Second position 24*d* is located on a radially outer side of first position 24*c*. First position 24*c* has first width L1 in the direction of rotation. Second position 24*d* has second width L2 in the direction of rotation. Second width L2 is greater than first width L1.

In planar portion 24, a portion of centrifugal impeller 11 located on the outer circumferential side is formed to be ahead of a portion located on the side of hub 31 in the direction of rotation. From a different point of view, end portion 29 of centrifugal impeller 11 (see FIG. 3) includes edge portion 24*a* located on the front side in the direction of rotation as shown in FIG. 6. Edge portion 24*a* is in a curved shape when viewed in a direction along the axis of rotation as shown in FIG. 6. Edge portion 24*a* extends as being curved radially outward form the axis of rotation. Edge portion 24*a* is in a curved shape which projects toward a side opposite to the direction of rotation as shown with a dotted arrow in FIG. 6. Edge portion 24*a* may be in a linear shape which radially extends from the axis of rotation. Edge portion 24*a* may be in a curved shape which projects in the direction of rotation. As shown in FIG. 2, a height of rotor blade 23 in the direction of the axis of rotation, that is, a blade height, may be uniform from the side of hub 31 toward the outer circumference.

As shown in FIG. 7, rotor blade 23 may have an inflection point 28 at a position distant by a prescribed distance from a front edge portion of second surface 27 which is the negative pressure surface on a side of a reverse direction of rotation. In second surface 27, a front-side region 27*a* on a side of planar portion 24 relative to inflection point 28 and a rear-side region 27*b* located on a rear side in the direction of rotation relative to inflection point 28 may be curved surfaces different in radius of curvature from each other. From a different point of view, as shown in FIG. 3, second surface 27 includes a first portion 34 distant by a first distance from end portion 29 and a second portion 35 distant from end portion 29 by a second distance different from the first distance, in a cross-section along the direction of rotation. First portion 34 is different in radius of curvature from second portion 35.

As shown in FIG. 1, fan cover 16 is placed on an outer side of rotor blade 23 in the direction of axis of rotation 40 of centrifugal impeller 11 so as to accommodate centrifugal impeller 11 and a stator vane 12 of a diffuser 15. In a central portion of fan cover 16, a bell mouth 18 defining an opening is provided at a position opposed to a suction port 17 of centrifugal impeller 11.

In a side surface of an electric blower 7, a bracket 19 which is coupled to fan cover 16 and accommodates a return stator vane 13 is provided. A gap 21 as a direction change portion which serves as a flow path from stator vane 12 toward return stator vane 13 is provided between fan cover 16 and diffuser 15. Diffuser 15 has a main plate 14 which couples stator vane 12 and return stator vane 13 to each other. A motor frame 20 which is coupled to bracket 19 and accommodates motor portion 9 is provided below bracket 19. Several discharge ports 22 through which air which has passed through centrifugal impeller 11, diffuser 15, and motor portion 9 is discharged are provided in motor frame 20.

Figure 8:
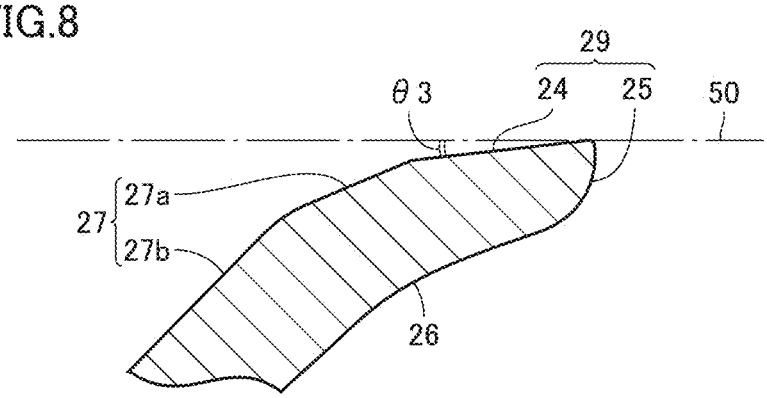
FIG. 8 is an enlarged view of a cross-section on the front edge side of a rotor blade of a centrifugal impeller in a modification of the first embodiment of the present invention.

As shown in FIG. 1 or 7, planar portion 24 is formed to extend in the direction perpendicular to the axis of rotation, however, planar portion 24 may be formed to be inclined with respect to the direction perpendicular to the axis of rotation as shown in FIG. 8. Rotor blade 23 may be formed such that a direction of extension of planar portion 24 is inclined by a prescribed angle θ3 with respect to the perpendicular direction shown with a line segment 50 in FIG. 8. Though all of the plurality of rotor blades 23 may be constructed as above in centrifugal impeller 11, at least one of the plurality of rotor blades 23 should only be constructed as above.

<Operations by Centrifugal Impeller and Electric Blower>

When electric power is supplied to motor portion 9 of electric blower 7, shaft 10 rotates. As shaft 10 rotates, centrifugal impeller 11 fixed to shaft 10 rotates and suctions air through suction port 17 of bell mouth 18. Air suctioned into centrifugal impeller 11 is increased in pressure and speed by centrifugal impeller 11 and moves radially outward while it swirls. Most of air discharged from centrifugal impeller 11 is reduced in speed and increased in pressure between stator vanes 12 of diffuser 15. Thereafter, air passes through gap 21 between diffuser 15 and fan cover 16. Furthermore, air is guided toward motor portion 9 by return stator vane 13 and cools motor portion 9. Thereafter, air is exhausted from discharge ports 22 provided in motor frame 20 to the outside of the electric blower.

<Function and Effect of Centrifugal Impeller and Electric Blower>

In the present first embodiment, centrifugal impeller 11 includes substantially conical hub 31 and a plurality of rotor blades provided on hub 31 in the circumferential direction. End portion 29 which is the front edge of rotor blade 23 is formed by planar portion 24 and curved portion 25. Curved portion 25 is coupled to first surface 26 which is the pressure surface on the side of the direction of rotation of rotor blade 23. Therefore, a part of a flow of air into end portion 29 is rectified as air flows along planar portion 24, and air flows toward second surface 27 without separating from planar portion 24. Since a region in end portion 29 located on the side of first surface 26 which is the pressure surface is provided as curved portion 25, another part of the flow of air is smoothly guided to first surface 26. Separation of a flow of air at end portion 29 is suppressed. Consequently, loss at end portion 29 which is the front edge is reduced and electric blower 7 high in efficiency and suction power can be obtained.

Regarding width L of planar portion 24, as shown in FIG. 6, width L2 on the outer circumferential side is greater than width L1 on the hub side. Consequently, planar portion 24 on the outer circumferential side where an amount of inflow air is larger than on the hub side can be greater in size than planar portion 24 on the hub side. Therefore, an effect of prevention of separation achieved by planar portion 24 can be enhanced on the outer circumferential side where a relative amount of inflow air is large.

The outer circumferential side of planar portion 24 may be ahead of the hub side in the direction of rotation. In this case, a length of rotor blade 23 on the outer circumferential side where a cross-sectional area of an air path is relatively large can be longer rather than on the hub side where a cross-sectional area of the air path is relatively small. Therefore, an amount of air can be increased while increase in loss is suppressed.

Rotor blade 23 is provided with inflection point 28 on second surface 27 which is the negative pressure surface on the side of the reverse direction of rotation. From a different point of view, first portion 34 and second portion 35 different in radius of curvature from each other are formed in second surface 27. In this case, a shape of rotor blade 23 can be in conformity with a flow of air by changing a position of inflection point 28 in accordance with a range of amounts of air in which centrifugal impeller 11 is used or adjusting a local radius of curvature in second surface 27 in accordance with the range of amounts of air. Consequently, centrifugal impeller 11 high in efficiency can be obtained.

Second Embodiment

<Configuration of Centrifugal Impeller>

Figure 9:
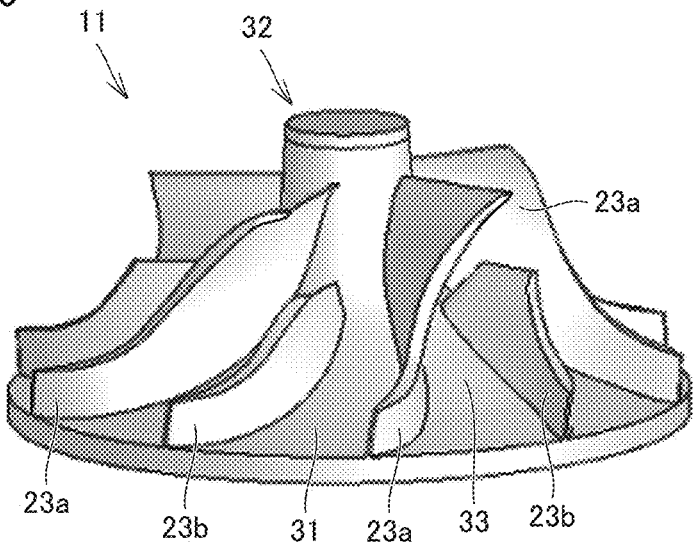
FIG. 9 is a perspective view of a centrifugal impeller in a second embodiment of the present invention.

As shown in FIG. 9, a centrifugal impeller making up an electric blower according to the present embodiment is basically similar in configuration to centrifugal impeller 11 shown in FIG. 2, however, it is different in including a first rotor blade 23*a* and a second rotor blade 23*b* as a plurality of rotor blades. Second rotor blade 23*b* is different in height from first rotor blade 23*a* in the direction along the axis of rotation. In FIG. 9, second rotor blade 23*b* as an intermediate blade is lower in height than first rotor blade 23*a*. Though FIG. 9 shows an example in which two types of rotor blades different in height are provided as rotor blades, three or more types of rotor blades may be provided. For example, three or more types of rotor blades different from one another in height in the direction along the axis of rotation may be employed.

<Function and Effect of Centrifugal Impeller>

The centrifugal impeller described above achieves an effect the same as that of the centrifugal impeller in the first embodiment of the present invention. In addition, in the centrifugal impeller shown in FIG. 9, the number of rotor blades increases from the central portion to the outer circumferential portion in the surface portion of the hub, that is, from an intermediate portion to a rear end portion of a flow path of air. Therefore, since air flows along first rotor blade 23*a* of centrifugal impeller 11 on a side where an amount of air is small, an internal secondary flow decreases and a centrifugal impeller high in efficiency can be obtained.

Third Embodiment

<Configuration of Electric Vacuum Cleaner>

Figure 10:
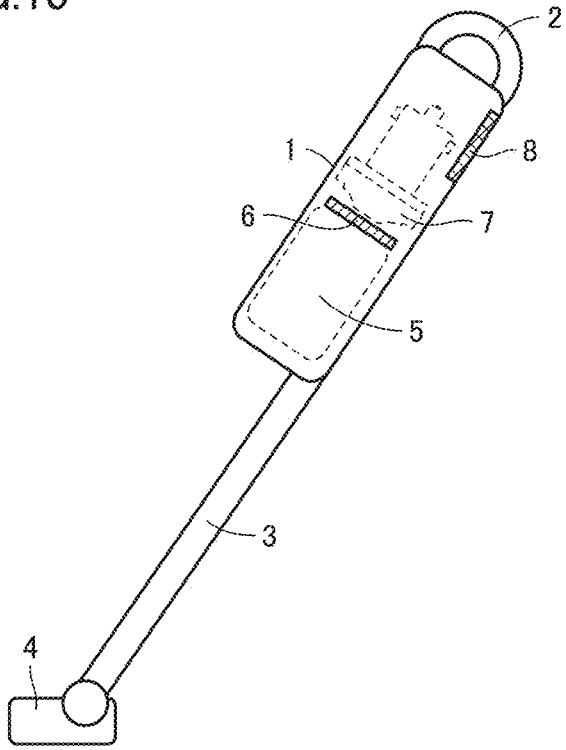
FIG. 10 is a schematic diagram for illustrating an overall configuration of an electric vacuum cleaner in a third embodiment of the present invention.

FIG. 10 is a schematic diagram of an electric vacuum cleaner in a third embodiment of the present invention. In FIG. 10, the electric vacuum cleaner includes an electric vacuum cleaner main body 1, a handle 2 connected to electric vacuum cleaner main body 1, an extension pipe 3, and a suction unit 4 attached to a tip end portion of extension pipe 3.

In electric vacuum cleaner main body 1, a dust collecting portion 5 which collects and stores dust in air suctioned by suction unit 4, a filter 6, and electric blower 7 which suctions air from suction unit 4 into dust collecting portion 5 are provided. Electric blower 7 includes centrifugal impeller 11 according to the embodiment of the present invention. In a rear portion of electric vacuum cleaner main body 1, an exhaust port 8 for exhaust of air from which dust has been collected by dust collecting portion 5 to the outside of electric vacuum cleaner main body 1 is provided. From a different point of view, the electric vacuum cleaner shown in FIG. 10 includes electric vacuum cleaner main body 1, suction unit 4, dust collecting portion 5, and electric blower 7. Suction unit 4 is coupled to electric vacuum cleaner main body 1 through extension pipe 3 as a pipe and suctions air in a cleaned portion. Dust collecting portion 5 is provided in electric vacuum cleaner main body 1, communicates with suction unit 4, and stores dust in suctioned air. Electric blower 7 is provided in electric vacuum cleaner main body 1 and suctions air from suction unit 4 into dust collecting portion 5. Exhaust port 8 for exhaust of air from which dust has been collected by dust collecting portion 5 to the outside of electric vacuum cleaner main body 1 is provided on an outer side of electric vacuum cleaner main body 1.

<Operations and Function and Effect of Electric Vacuum Cleaner>

Operations by the electric vacuum cleaner will now be described.

In the electric vacuum cleaner configured as described above, when electric power is supplied to motor portion 9 (see FIG. 1) of electric blower 7, shaft 10 (see FIG. 1) rotates. As shown in FIG. 1, as shaft 10 rotates, centrifugal impeller 11 fixed to shaft 10 rotates and suctions air through suction port 17. Thus, air at a cleaned surface is suctioned into electric vacuum cleaner main body 1 through extension pipe 3 coupled to electric vacuum cleaner main body 1 shown in FIG. 10 and suction unit 4. Dust in air suctioned into electric vacuum cleaner main body 1 is collected in dust collecting portion 5.

Thereafter, air exhausted from dust collecting portion 5 passes through bell mouth 18 of electric blower 7 and is suctioned through suction port 17 of centrifugal impeller 11 as shown in FIG. 1. Air suctioned into centrifugal impeller 11 is increased in pressure and speed by centrifugal impeller 11 and moves radially outward while it swirls. Most of air discharged from centrifugal impeller 11 is decreased in speed and increased in pressure between stator vanes 12 of diffuser 15 and thereafter passes through gap 21 between diffuser 15 and fan cover 16. Air is further guided toward motor portion 9 by return stator vane 13 and cools motor portion 9. Thereafter, air is exhausted from discharge ports 22 provided in motor frame 20 to the outside of the electric blower. Then, air is exhausted from exhaust port 8 provided in vacuum cleaner main body 1 shown in FIG. 10 to the outside of electric vacuum cleaner main body 1.

Since electric blower 7 according to the embodiment of the present invention described above is employed in the electric vacuum cleaner described above, an electric vacuum cleaner which is highly efficient and has a long lifetime can consequently be obtained.

Electric blower 7 in the present embodiment can be applied to an electric vacuum cleaner different in type from the electric vacuum cleaner described above. For example, electric blower 7 in the present embodiment may be applied to a canister type electric vacuum cleaner in which a hose and an extension pipe are coupled to electric vacuum cleaner main body 1.

Fourth Embodiment

<Configuration and Function and Effect of Hand Dryer>

Figure 11:
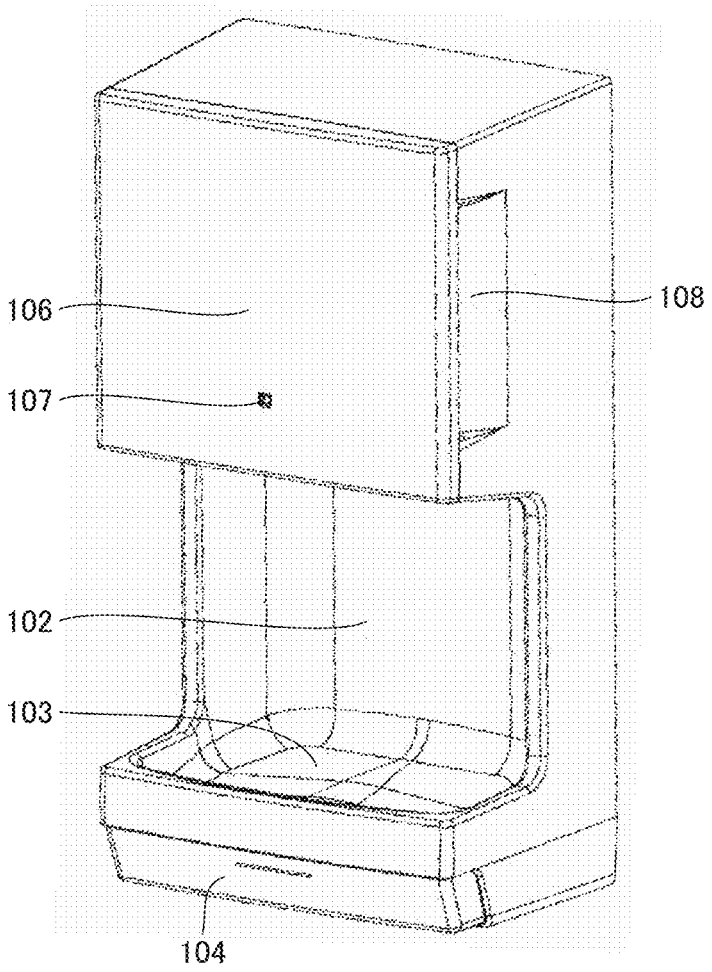
FIG. 11 is a schematic perspective view for illustrating an overall configuration of a hand dryer in a fourth embodiment of the present invention.
Figure 12:
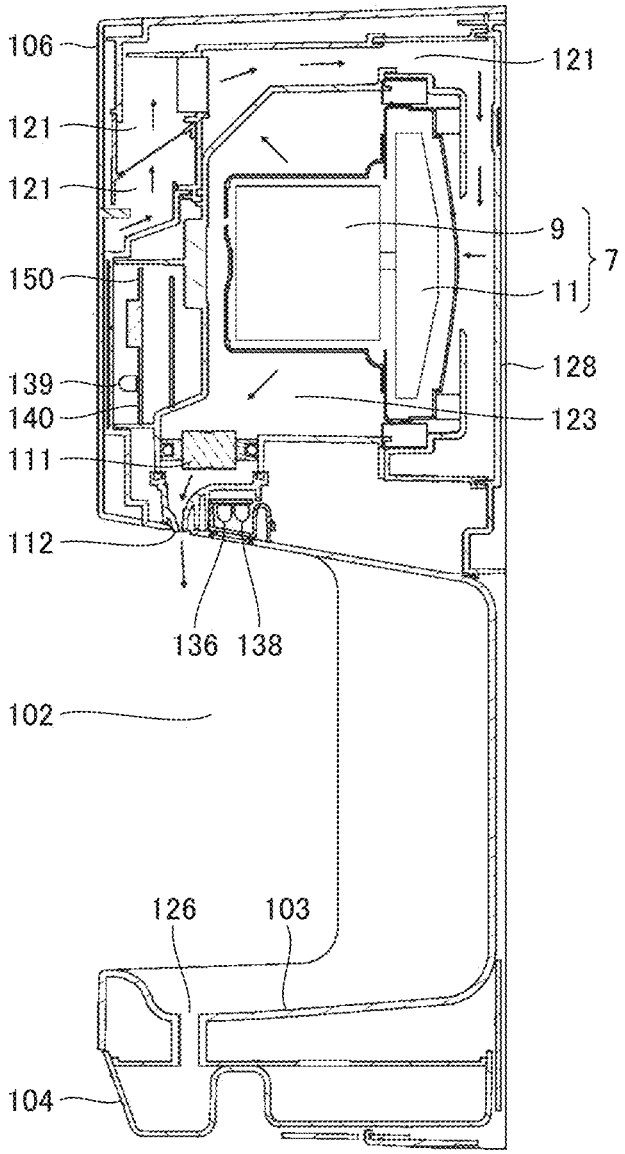
FIG. 12 is a schematic cross-sectional view of the hand dryer shown in FIG. 11.

A hand dryer according to the embodiment of the present invention shown in FIGS. 11 and 12 includes a casing 106 as a main body, a hand insertion portion 102, a water receiving portion 103, a drain container 104, a light passage window 107, and an air inlet 108. The hand dryer has electric blower 7 in casing 106. The hand dryer blows water away from a hand by sending air from electric blower 7 in response to insertion of the hand into hand insertion portion 102 which is an opening located above water receiving portion 103. Water that is blown away is stored in drain container 104 from water receiving portion 103.

As shown in FIGS. 11 and 12, casing 106 which defines an outer shell of the hand dryer has a hand insertion opening in its front surface. Casing 106 includes hand insertion portion 102 as a treatment space continuing to the hand insertion opening. A user can insert his/her hand into hand insertion portion 102. Hand insertion portion 102 is provided as a recess like an open sink of which front surface and opposing side surfaces are open, in a lower portion of the front surface of casing 106. Water receiving portion 103 is arranged to form a lower portion of hand insertion portion 102. As shown in FIG. 12, a bottom portion of water receiving portion 103 is inclined downward in a forward direction and a drain outlet 126 is provided at a lower end of inclination. Drain container 104 which stores water dropping from drain outlet 126 is removably provided below water receiving portion 103. A nozzle 112 as an air outlet through which high-speed air is blown downward toward hand insertion portion 102 is provided above hand insertion portion 102.

Electric blower 7 including motor portion 9 and a turbo fan representing centrifugal impeller 11 which is fixed to a rotation shaft of motor portion 9 and rotates is arranged in a box-shaped space above hand insertion portion 102 defined by casing 106 and a base 128 which defines the outer shell on a rear surface side of the hand dryer. Electric blower 7 is driven, for example, by externally supplied electric power or electric power from a power supply such as a battery arranged in casing 106. In the box-shaped space, an intake air path 121 which communicates an air suction side of electric blower 7 and air inlet 108 provided in a side surface of casing 106 with each other and an exhaust air path 123 which communicates an exhaust side of electric blower 7 and nozzle 112 with each other are provided.

A heater 111 which heats air sent from electric blower 7 to warm air is provided around upstream from nozzle 112 at some midpoint of exhaust air path 123. A circuit board including a hand sensor 136 and an illumination LED 138 is provided in casing 106 on a rear surface side of nozzle 112 as the air outlet. A direction of light emission and a direction of light reception of hand sensor 136 and a direction of light emission from illumination LED 138 are set toward hand insertion portion 102. Hand sensor 136 senses whether or not a hand is present in hand insertion portion 102 through a light passage window provided in a part of casing 106 above hand insertion portion 102 through which visible light rays or infrared rays pass. As insertion of a hand into hand insertion portion 102 is detected, illumination LED 138 as illumination means lights hand insertion portion 102.

A control circuit 150, a power feed LED 139 as power feed indication means which indicates, by illuminating, power feed in a stand-by state after turn-on of power, and a circuit board 140 including a switch as switching means capable of independently switching ON/OFF illumination of illumination LED 138 and power feed LED 139 are provided within casing 106 around the front surface of casing 106. A direction of light emission from power feed LED 139 and a switch operation surface are set to face front. Light passage window 107 is provided in casing 106 such that light from power feed LED 139 can visually be recognized from the outside of casing 106.

Operation by Hand Dryer According to Present Embodiment

An operation during use for drying a hand will now be described. When a power switch of an electrical apparatus as a hand dryer is turned on, power is fed to control circuit 150 arranged in casing 106 and a state ready for drying of a hand (which is referred to as a stand-by state below) is set. When power is fed to control circuit 150 with illumination LED 138 being switched to on, illumination LED 138 illuminates, and with power feed LED 139 being switched to on, power feed LED 139 illuminates. When a user inserts his/her wet hand into hand insertion portion 102 through the hand insertion opening as far as around his/her wrist, hand sensor 136 senses insertion of the hand. Consequently, control circuit 150 activates electric blower 7.

When electric blower 7 is activated, air outside the hand dryer is suctioned through air inlet 108 provided in opposing side surfaces of casing 106. Air suctioned through air inlet 108 passes through intake air path 121 and moves toward the rear surface through an upper portion of electric blower 7. Then, air moves downward and suctioned from a suction side of electric blower 7. Electric blower 7 converts air suctioned from the suction side into high-pressure air and exhausts high-pressure air from an exhaust side. Exhausted high-pressure air passes through exhaust air path 123, reaches nozzle 112, and is converted to a high-speed air flow with high kinetic energy. The high-speed air flow is blown out of nozzle 112 downward into hand insertion portion 102. The high-speed air flow blown from nozzle 112 impinges on a wet hand put into hand insertion portion 102 and separates and blows away water attached to the hand from a surface of the hand. The hand can thus be dried. When a heater switch (not shown) provided in casing 106 is on, heater 111 is fed with power and high-pressure air which passes through exhaust air path 123 is heated. Therefore, warm air is blown out of nozzle 112 and comfortable feeling of use by a user can be kept also during winter.

When a hand is pulled out of hand insertion portion 102 after the end of treatment for drying a hand, hand sensor 136 senses removal of the hand and the electric blower is deactivated. Water droplets blown away from the hand flow down toward drain outlet 126 in water receiving portion 103 structured to be inclined forward and stored in drain container 104 through drain outlet 126.

Since the hand dryer described above includes electric blower 7 according to the present embodiment described above, loss can be lessened and consequently a hand dryer which achieves high efficiency and a long lifetime can be obtained.

Though embodiments of the present invention have been described as above, the embodiments described above can also variously be modified. The scope of the present invention is not limited to the embodiments described above. The scope of the present invention is defined by the terms of the claims and is intended to include any modifications within the scope and meaning equivalent to the terms of the claims.

INDUSTRIAL APPLICABILITY

The present invention can advantageously be applied to an apparatus including an electric blower such as a home or industrial-strength electric vacuum cleaner or a hand dryer.

REFERENCE SIGNS LIST

1 electric vacuum cleaner main body; 2 handle; 3 extension pipe; 4 suction unit; 5 dust collecting portion; 6 filter; 7 electric blower; 8 outlet; 9 motor portion; 10 shaft; 11 centrifugal impeller; 12 stator vane; 13 return stator vane; 14 main plate; 15 diffuser; 16 fan cover; 17 suction port; 18 bell mouth; 19 bracket; 20 motor frame; 21 gap; 22 discharge port; 23 rotor blade; 23*a* first rotor blade; 23*b* second rotor blade; 24 planar portion; 24*a* edge portion; 24*b* boundary portion; 24*c* first position; 24*d* second position; 25 curved portion; 26 first surface; 27 second surface; 27*a* front-side region; 27*b* rear-side region; 28 inflection point; 29 end portion; 31 hub; 32 central portion; 33 surface portion; 34 first portion; 35 second portion; 40 axis of rotation; 41, 42, 50 line segment; 102 hand insertion portion; 103 water receiving portion; 104 drain container; 106 casing; 107 light passage window; 108 air inlet; 111 heater; 112 nozzle; 121 intake air path; 123 exhaust air path; 126 drain outlet; 128 base; 136 hand sensor; 140 circuit board; 150 control circuit

The invention claimed is:

1. A centrifugal impeller comprising:

a hub; and a plurality of rotor blades, the hub having a circular outer geometry in a plan view, the hub comprising a central portion protruding in a direction of an axis of rotation of the hub and a surface portion inclined from the central portion toward an outer circumferential portion of the hub, the plurality of rotor blades being coupled to the surface portion of the hub, at least one of the plurality of rotor blades comprising an end portion located on a front side in a direction of rotation of the plurality of rotor blades, a first surface continuous to the end portion and located on the front side in the direction of rotation, and a second surface continuous to the end portion and located on a side opposite to the first surface, the end portion comprising a planar portion and a curved portion, the planar portion being continuous to the second surface and having a flat surface, the curved portion connecting the planar portion and the first surface to each other and having a curved surface, and the planar portion and the hub being connected so as to intersect in a view from a perpendicular direction to the axis of rotation of the hub, wherein the planar portion is formed to extend radially outward from the axis of rotation, a thickness of the planar portion in the direction of rotation increases as the planar portion extends outwardly from the axis of rotation, the planar portion comprises a first position and a second position located on a radially outer side of the first position, the first position has a first width in the direction of rotation, the second position has a second width in the direction of rotation, the second width is greater than the first width, and a width of the planar portion at a position closest to the axis of rotation is narrowest of all widths of the planar portion in the direction of rotation.

2. The centrifugal impeller according to claim 1, wherein the end portion comprises an edge portion located on the front side in the direction of rotation, and the edge portion extends as being curved radially outward from the axis of rotation when viewed in a direction along the axis of rotation.

3. The centrifugal impeller according to claim 1, wherein the second surface is a curved surface, the second surface comprises a first portion distant by a first distance from the end portion and a second portion distant from the end portion by a second distance different from the first distance, in a cross-section along the direction of rotation, and the first portion is different in radius of curvature from the second portion.

4. The centrifugal impeller according to claim 1, wherein the plurality of rotor blades comprise a first rotor blade and a second rotor blade different in height from the first rotor blade in a direction along the axis of rotation.

5. An electric blower comprising:

the centrifugal impeller according to claim 1; and a motor portion which rotates the centrifugal impeller.

6. An electric vacuum cleaner comprising:

an electric vacuum cleaner main body;

a suction unit which is coupled to the electric vacuum cleaner main body through a pipe and suctions air in a cleaned portion;

a dust collecting portion which is provided in the electric vacuum cleaner main body, communicates with the suction unit, and stores dust in suctioned air;

the electric blower according to claim 5 which is provided in the electric vacuum cleaner main body and suctions air from the suction unit to the dust collecting portion; and an exhaust port being provided on an outer side of the electric vacuum cleaner main body, the exhaust port serving to exhaust air from which dust has been collected by the dust collecting portion to outside of the electric vacuum cleaner main body.

7. A hand dryer comprising:

a main body comprising a hand insertion portion which is an opening into which a user puts a hand; and the electric blower according to claim 5 provided in the main body, the main body being provided with an air inlet for intake of outdoor air by the electric blower and an air outlet for blowing the outdoor air sent from the electric blower toward the hand insertion portion.

8. The centrifugal impeller according to claim 1, wherein the planar portion is formed to extend to a perpendicular direction to the axis of rotation of the hub.

9. The centrifugal impeller according to claim 1, wherein the planar portion is formed so as to be inclined with respect to a perpendicular direction to the axis of rotation of the hub.

10. A centrifugal impeller comprising:

a hub; and a plurality of rotor blades, the hub having a circular outer geometry in a plan view, the hub comprising a central portion protruding in a direction of an axis of rotation of the hub and a surface portion inclined from the central portion toward an outer circumferential portion of the hub, the plurality of rotor blades being coupled to the surface portion of the hub, at least one of the plurality of rotor blades comprising an end portion located on a front side in a direction of rotation of the plurality of rotor blades, a first surface continuous to the end portion and located on the front side in the direction of rotation, and a second surface continuous to the end portion and located on a side opposite to the first surface, the end portion comprising a planar portion and a curved portion, the planar portion being continuous to the second surface and having a flat surface, the curved portion connecting the planar portion and the first surface to each other and having a curved surface, and the rotor blade including a side that extends along the axis of rotation of the hub in an outer circumferential portion side of the hub, wherein the planar portion is formed to extend radially outward from the axis of rotation, a thickness of the planar portion in the direction of rotation increases as the planar portion extends outwardly from the axis of rotation, the planar portion comprises a first position and a second position located on a radially outer side of the first position, the first position has a first width in the direction of rotation, the second position has a second width in the direction of rotation, the second width is greater than the first width, and a width of the planar portion at a position closest to the axis of rotation is narrowest of all widths of the planar portion in the direction of rotation.

11. The centrifugal impeller according to claim 10, wherein the end portion comprises an edge portion located on the front side in the direction of rotation, and the edge portion extends as being curved radially outward from the axis of rotation when viewed in a direction along the axis of rotation.

12. The centrifugal impeller according to claim 10, wherein the second surface is a curved surface, the second surface comprises a first portion distant by a first distance from the end portion and a second portion distant from the end portion by a second distance different from the first distance, in a cross-section along the direction of rotation, and the first portion is different in radius of curvature from the second portion.

13. The centrifugal impeller according to claim 10, wherein the plurality of rotor blades comprise a first rotor blade and a second rotor blade different in height from the first rotor blade in a direction along the axis of rotation.

14. An electric blower comprising:

the centrifugal impeller according to claim 10; and a motor portion which rotates the centrifugal impeller.

15. An electric vacuum cleaner comprising:

an electric vacuum cleaner main body;

a suction unit which is coupled to the electric vacuum cleaner main body through a pipe and suctions air in a cleaned portion;

a dust collecting portion which is provided in the electric vacuum cleaner main body, communicates with the suction unit, and stores dust in suctioned air;

the electric blower according to claim 14 which is provided in the electric vacuum cleaner main body and suctions air from the suction unit to the dust collecting portion; and an exhaust port being provided on an outer side of the electric vacuum cleaner main body, the exhaust port serving to exhaust air from which dust has been collected by the dust collecting portion to outside of the electric vacuum cleaner main body.

16. A hand dryer comprising:

a main body comprising a hand insertion portion which is an opening into which a user puts a hand; and the electric blower according to claim 14 provided in the main body, the main body being provided with an air inlet for intake of outdoor air by the electric blower and an air outlet for blowing the outdoor air sent from the electric blower toward the hand insertion portion.

17. The centrifugal impeller according to claim 10, wherein the planar portion is formed to extend to a perpendicular direction to the axis of rotation of the hub.

18. The centrifugal impeller according to claim 10, wherein the planar portion is formed so as to be inclined with respect to a perpendicular direction to the axis of rotation of the hub.

* * * * *